US005228947A

United States Patent [19]

Churchland

[11] Patent Number: 5,228,947

[45] Date of Patent: Jul. 20, 1993

[54] MICROWAVE CURING SYSTEM

[75] Inventor: Mark T. Churchland, Vancouver, Canada

[73] Assignee: Trus Joist MacMillan, a Limited Partnership, Boise, Id.

[21] Appl. No.: 736,951

[22] Filed: Jul. 30, 1991

Related U.S. Application Data

[63] Continuation-in-part of Ser. No. 557,652, Jul. 27, 1990, abandoned, and a continuation-in-part of Ser. No. 575,007, Aug. 30, 1990, abandoned, which is a continuation-in-part of Ser. No. 555,732, Jul. 23, 1990, abandoned.

[51] Int. Cl.[5] ..... B30B 5/00; B30B 15/34; H05B 6/64

[52] U.S. Cl. ..... 156/580.1; 156/583.1; 156/583.5; 219/10.55 A; 219/10.55 F; 333/137

[58] Field of Search ..... 156/580.1, 580.2, 379.6, 156/380.9, 583.1, 583.5; 219/10.55 R, 10.55 A, 10.55 F; 333/137

[56] References Cited

U.S. PATENT DOCUMENTS

| | | | |
|---|---|---|---|
| 2,719,230 | 9/1955 | Smoll et al. | 343/786 X |
| 3,493,021 | 2/1970 | Champigny | 144/348 |
| 3,530,482 | 9/1970 | Palmer | 343/786 |
| 4,005,301 | 1/1977 | Thourel | 219/10.55 A |
| 4,018,642 | 4/1977 | Pike et al. | 156/272 |
| 4,020,311 | 4/1977 | Churchland | 219/10.55 A |
| 4,456,498 | 6/1984 | Churchland | 156/275.5 |
| 4,508,772 | 4/1985 | Churchland et al. | 428/106 |
| 4,517,148 | 5/1985 | Churchland | 264/112 |
| 4,546,886 | 10/1985 | Churchland et al. | 209/665 |
| 4,563,237 | 1/1986 | Churchland et al. | 156/62.2 |
| 4,609,417 | 9/1986 | Smith | 156/69 |
| 4,667,205 | 5/1987 | Gehin | 343/783 |
| 4,706,799 | 11/1987 | Churchland et al. | 198/457 |
| 4,872,544 | 10/1989 | Churchland et al. | 198/382 |
| 4,879,444 | 11/1989 | Bichot et al. | 219/10.55 A |
| 4,906,309 | 3/1990 | Bichot et al. | 156/62.6 |

*Primary Examiner*—David A. Simmons
*Assistant Examiner*—J. Sells
*Attorney, Agent, or Firm*—Banner, Birch, McKie & Beckett

[57] ABSTRACT

A system for the simultaneous application of pressure and microwaves to a thick mat of curable assemblies. As the curable assemblies are conveyed through a belt press, microwaves are applied to them through an adjacent, rapidly expanding applicator horn. A microwave-transparent ceramic dam or window across the outlet of the horn blocks the compressed assemblies from entering the horn. To minimize any heat cracking of the window it is formed of a number of pieces. These pieces are held in place at the horn outlet by one or more fins secured within the horn and extending into the window. The fins extend across the interior of the horn and divide it into a number of different microwave paths. The ceramic window pieces at the ends of the paths are carefully shaped, with a cylindrical rear surface, to act as lenses and to act on the microwave energy from each of the different paths so that the microwaves from all of the paths are in phase at the product interface. Air is pumped through a serpentine path in the window to cool it and help prevent cracking thereof. Applicator horns having different heating patterns can be advantageously used at different locations along the press bed.

31 Claims, 14 Drawing Sheets

MICROWAVE CURING SYSTEM

CROSS-REFERENCE TO RELATED APPLICATIONS

This is a continuation-in-part of copending applications (1) Ser. No. 07/557,652, filed Jul. 27, 1990 abandoned, and (2) Ser. No. 07/575,007 ('007), filed Aug. 30, 1990 abandoned, which is a continuation-in-part of Ser. No. 07/555,732 ('732), filed Jul. 23, 1990 abandoned. These and each of the other applications, publications and patents mentioned anywhere in this disclosure are hereby incorporated by reference in their entireties.

BACKGROUND OF THE INVENTION

The present invention relates to systems for continuously manufacturing composite, adhesively bonded products in which pressure and microwave heat are applied simultaneously to curable assemblies. The adhesive bonding agent is thereby cured or set while the product is pressed and/or maintained at the desired dimensions and density. The invention further relates to microwave methods for curing resins used as binders or adhesives for materials, such as wood particles, wood chips, wood wafers, wood strips, wood fibers and wood veneers, used in the production of chip board, hard board, particle board, wafer board, plywood and other composite products.

Wood products of this type have been subjected in the past to heat and pressure in hot presses. Wood, however, is a relatively poor conductor of heat, and the heat from the platens of the hot press can only be directed against the outer surfaces of the wood product being formed. Consequently, considerable time was required for the necessary heat to penetrate to the center of the wood product and to cure the resin therein. If the temperature was increased beyond a certain amount to reduce the curing time required, scorching or charring of the outer surfaces of the wood product resulted. These higher temperatures also were difficult and expensive to attain since they required greater steam pressure and additional equipment. Additionally, at higher temperatures, water which may be entrapped can result in steam explosion in the product.

Numerous attempts have been made to use radio frequency (R.F.) energy, that is, dielectric heating, to cure the resin. Where R.F. heating techniques were used and especially where the phenolic resin layer was thick, arcing and tracking in the resin resulted. This undesirable phenomena appears to be due to the relatively high activity of some resins which leads to breakdowns when subjected to R.F. fields of the necessary field strength. Although the arcing and tracking problem can be reduced significantly if the R.F. field is applied transverse to the glue line, transverse application reduces the efficiency of the process.

Application of microwave energy has been used in recent years to cure, in composite masses, adhesives which have cure rates which are accelerated by the application of heat. Microwave heating can be more rapid, that is, it can provide a shorter cure time, than conventional heating or hot press processes, and therefore allows for a continuous production technique as compared to batch processes. Arcing and tracking common with the R.F. technique are also not a problem. For example, U.S. Pat. Nos. 4,018,642 and 4,020,311 disclose techniques for simultaneously applying microwaves and pressure to curable assemblies.

An improved microwave applicator for continuous presses is disclosed in U.S. Pat. No. 4,456,498 ('498), and the present invention is an improvement thereon. (The '498 patent was also cited in recent U.S. Pat. Nos. 4,609,417, 4,879,444 and 4,906,309.) The '498 patent shows a pair of endless belts forming a nip region, a press chamber defined by the belts in the nip region and by two side walls, a means for applying microwaves to the curable assemblies through a waveguide which forms an interface with the press chamber located in an opening in the side wall, and a window or dam at the interface between the waveguide and the press chamber and having sufficient strength to withstand the lateral pressures exerted thereon by the curable assemblies as they are being pressed and to thereby block the entry of the assemblies into the waveguide. This window was constructed of a material which is strong, rigid, abrasion resistant, impermeable to adhesives and transparent to microwave energy. Ceramic materials are examples of such materials, and a preferred ceramic material is aluminum oxide (alumina). The applicator system as disclosed in the '498 patent works well on product depths of four inches or less.

An example of a more recent applicator is shown in FIG. 1 generally at 100. (This applicator is prior art for U.S. patent practice, since it has been in secret commercial use for more than one year.) Referring thereto, it is seen that the applicator waveguide 102 is shaped with a fifteen degree angle as shown by reference numeral 104 in a rapidly expanding horn to define an opening 106 having a depth or height of 7.6 inches as shown by dimension 108. The location of the quarter wave trap of this waveguide is shown at 109. The inlet to the horn or waveguide 102 as shown by dimension 110 is 2.17 inches. Positioned behind the ceramic window 112 is a piece of Teflon 114 which is about two inches thick and 9.75 inches wide. The front face of the ceramic window 112 is ten inches wide and has a rectangular configuration. This design for a 7.6 inch depth product worked relatively well and did not generally present any tremendous heating pattern problems. Some degree of uneven heating and occasional product browning was experienced with the 7.5 inch depth product using the applicator or waveguide 102 of FIG. 1, but when the size of this applicator was increased for an 11.4 inches opening, to produce a desirably larger product, the uneven heating patterns worsened and became unacceptable.

FIG. 2 shows generally at 120 a temperature profile using a rapidly expanding horn similar to that of FIG. 1 and for a product depth or window opening of 11.4 inches. This is a temperature profile for dielectric conditions of epsilon prime equaling three and epsilon double prime equaling 0.3. The temperature profile in the product 122 shows the extremes of upwards of 170° C. at the edge of the ceramic window 112 and window **112*a* (of a similar microwave system on the other belt side) and a low temperature of 67° in the center. The profile thus comprises one massive low in the center of the product and two significant highs on the edges, with significant distances between them. Since the product 122 is fourteen inches wide, there is approximately seven inches from one edge or hot center to the middle or colder center. This means for the heating temperature in the microwave product 122 to even out that there must be a steam transport of approximately seven inches from the higher temperature to the lower temperature, and this is too great a transport distance. In other words, in the hot areas of the compressed mat or product 122 a considerable amount of the steam is generated due to the boiling of the water in the mat. Since boiling is an expansion process, a large volume of gas is created from the small volume of liquid which then tends to flow under pressure gradients to smooth out the low and high temperature spots. A significant evening of the high and low temperatures can only take place, however, if the highs and lows are not spaced too far apart, which is not the case with the "prior art" of FIG. 2. In fact, if the product of FIG. 2** were allowed to sit for ten or fifteen minutes, a chain saw cut then made through it and a thermograph (not shown) taken of the resulting cross-section, the temperatures in the cross-section would vary from thirty to forty degrees.

The main effect of an inconsistent temperature profile 120 is the resulting inconsistent normalization of the product 122. If the product has been heated to about 100°, for example, and then wetted, it will later spring back to the remembered prior size. On the other hand, if it is heated above 120°, not only has the glue been cured but the lignin has also softened and actually melted and the wood fibers caused to slide internally.

Similar problems have been experienced in other work and corrected using a steam post treatment of wafer board. Some times wafer board is hot pressed too quickly in order to speed the press cycle and the center of the board does not reach a sufficient temperature but rather only a point where it cures enough to hold itself together. Consequently, if the wafer board is later wetted it can spring up to approximately double its thickness, which is unacceptable for most end uses.

The present composite wood product (122) as described, for example, in copending U.S. application Ser. No. 07/555,000 ('000), filed Jul. 23, 1990, and entitled "System for Oriented Strand Layup," (and in Canadian application Serial No. 2,022,900-4), if cured correctly, has only about a two or three percent retained spring back in the compression direction after wetting and drying and in the other directions behaves similar to natural wood. In other words, if the present product is wetted and dried it will return to its original dimensions except in the compression dimension where after drying it will be two to three percent thicker than it originally was. If the higher temperatures are not obtained consistently, then a five or even ten percent increase in thickness after drying is experienced.

This swelling is undesirable for nearly every application since wood that is dimensionally stable is easier to engineer and to service and better able to survive a change in the elements. Often during construction, wood becomes quite wet and only by the fact that it has been placed inside a building that is eventually enclosed does natural evaporation dry the wood to an equilibrium of from about six to sixteen percent.

The (wood) product 122 resulting from the temperature profile 120 of FIG. 2 would most likely be a non-functioning beam. A temperature of 100° C. is needed to cure the glue. It is unlikely that the 120° area and the 140° area would have enough energy to bring the 67° center area to a full 100° temperature before the outside, currently at 170°, overheats to the point of browning the wood, which destroys the lignin cellulose matrix. In other words, under cured centers and edge browning result from the FIG. 1 applicator 100 when adapted and used on thicker products. A more even energy flow through this thick product is accordingly needed.

As previously mentioned, a microwave transparent dam 112 has been secured in a microwave curing system 100, such as that of FIG. 1 or of the '498 patent, to the outlet end of the waveguide to prevent the mat, as it is being conveyed and compressed thereagainst and therepast, from entering the waveguide. The dam thus must be strong enough to resist pressures of many hundreds of pounds per square inch. As the dam or window is made larger, for example ten inches across and 11.4 inches in depth to accommodate the larger or thicker product, thermal cracking thereof often occurs.

Another problem in the past has been that the final structural wood products from microwave curing presses of ten have uneven density profiles. If the temperature or moisture contents of the incoming mats are not consistent within a few degrees, instabilities in the change of temperature development, that is uneven heating occur in the microwave press for two reasons. First, the dielectric constant epsilon, both its real and imaginary parts, increases as temperature increases, which means that more energy is deposited into areas that are already warmer. This has a multiplier effect; that is, the warmer these areas get, the move they attract energy, and so forth. A second factor is that these layups are comprised of wood fiber, and wood is compressed as it is microwave heated. The wood is softer when it is warmer, and the warmer part is more easily compressed in the microwave field. As it compresses, the warmer areas take up more of the compression, soften and compress to a higher density sooner, which again increases their dielectric absorption. That is, more energy focuses into those areas, and as this happens they become softer and compress more readily and instability again results. Both of these factors work against even heating and even final product density in wood composite products.

For example, in a wood product with an 11.4 inch by 14.75 inch cross-section, the top and the bottom of the mat can be about 25° to 30° C., while the center two-thirds of the mat can be about 35° to 50° C., due to the natural progression of the water uptake. The center heats up since the water chemically binding to the cellulose lignin structure in the mat is an exothermic activity. As the mat progresses through the press, the top and bottom of the mat can have specific gravities of 0.5 gram per cubic centimeter, while that of the center two-thirds can be 0.6 to 0.65 gram per cc. Further, the moisture content of the 0.5 gram per cc top and bottom areas is about 12 to 13% of the dry basis of wood, while the 0.6 to 0.65 gram per cc has about 9 to 10% moisture content. The density gradient is important to these parameters, since whenever there is a density gradient there is also a strength parameter gradient. Accordingly, there is a different thermal normalizing effect on the compressed mat and thus a different moisture response. The cooler areas tend to expand more rapidly, more readily and more permanently on wetting, which can lead to bowing or splaying of the final product. The resulting density gradient thus has been found to be due to two factors. One is the uneven temperature and moisture profile of the mat as it enters the microwave press, and the other is the uneven microwave deposition pattern of the microwave applicator(s).

A prior art attempt to remedy this density gradient problem has been to raise the temperature of the entire mat. The temperature was raised by insulating the top and the bottom of the mat and then providing an oil heating system around the conveyor itself. More particularly, oil heating lines were positioned along the sides of the trough and heating devices underneath the bottom and insulation covers placed on top of the mat as soon as the last strands were deposited. The mat was thereby lifted out of the very sensitive operating range where these control parameters have their biggest effect. A mat that is entering the press with a 50° to 60° C. temperature has already experienced the bulk of its softening. Thus, even though it still has a temperature gradient of five to ten degrees, this gradient has less of an effect on the final product.

When the temperature of the entire mat is raised sufficiently, the mat behaves reasonably consistently in the microwave heating process. It does not compensate for inadequacies in the evenness of the microwave heating, however. The prior art system of heating the entire layup to make it hotter was thus not an attempt to control either the moisture or temperature beyond an even mat nor did it achieve an even mat temperature. A benefit of raising the temperature of the entire mat is that the effects of the ambient temperature are reduced but not eliminated. In other words, on hot summer days there is a different mat self-heating profile than on cold winter days, and these effects are reduced to a certain extent by heating the entire mat.

A significant disadvantage of this "whole mat" heating technique, however, is that if the temperature gets too high, for example to 60° or 70° C., then the glue in the mat can be precured, making the product useless. The product may still look good, consolidated and strong but if the glue was even partially cured before the final compression and microwave heating, there is little left to hold the wood strands or composite assemblies together. Aside from the precuring problem, there is also the problem that the entire mat as a practical matter is difficult to heat evenly since there are differential chemical reactions occurring with this water uptake. The mat is simply not stable enough to be totally heated to an even, higher temperature.

A prior art technology in the board industry for reducing press curing times is to radio frequency (RF) preheat the mat before it reaches the press. That is, an RF field is applied to the uncompressed mat to raise the temperature thereof to 50° to 70° C. or even higher before final compression and heating with a hot press. This board forming technique is usually a batch and not a continuous process, however, and the purpose of the RF preheating is to shorten the pressing time in the hot press. This mat is also formed very thin so that there is no significant steam transport within it. Further, this prior art board forming process does not involve any significant or positive compression of the mat. Thus, any small irregularities in preheating will not magnify during the process. When a mat is to be simultaneously heated and compressed (such as in the present processes described in detail below) compressibility during heating is very important and any instabilities tend to magnify.

SUMMARY OF THE INVENTION

Accordingly, it is a primary object of the present invention to provide an improved system for simultaneously exposing curable assemblies to pressure and microwave energy in a continuous process or belt press.

Another object of the present invention is to provide a microwave curing system which can simultaneously compress and cure masses of curable assemblies having larger depths of greater than seven and a half inches and more particularly 11.4 inches and with an even resultant heating pattern.

A further object of the present invention is to provide an improved window dam for a microwave applicator for curing larger depths of curable assemblies as they are conveyed therepast and compressed thereagainst and which window dam is less susceptible to thermal cracking.

Directed to achieving these objects, an improved microwave curing assembly for a continuous press is herein provided. The press includes a pair of endless metal press belts forming a nip region, the belts converging to apply pressure to the curable assemblies conveyed between them. A press chamber is defined by the two opposing press belts and by two side walls. Microwaves are applied to the curable assemblies within the chamber via a microwave applicator communicating at one end with a microwave generator and at the opposite end thereof with one of the side walls. A dam or blocking window is mounted at the interface of the outlet of the applicator and the press wall. This press can handle a larger depth of product than previously possible, on the order of 11.5 inches, without undercured centers or browned product edges resulting. The window then must have an overall height of 11.5 inches and the applicator is shaped as a rapidly expanding horn, due to the press configurations, expanding out to this 11.5 inch dimension and with a width of approximately ten inches.

To prevent cracking of this large window, it is formed of a number of window pieces held together by the metal horn assembly. More particularly, the window is formed with three spaced horizontal slots on its inside surface, and three fins are fitted into the slots and secured within the horn. The middle of the three fins extends a further distance back in the horn generally to the end thereof, and the upper and lower fins are shorter and angle inwardly a distance towards the middle fin. The fins extend the entire width of the horn and thereby define three generally independent microwave paths for the microwave energy entering the microwave horn. These paths help suppress the formation of modes of the microwaves other than $TE_{01}$ in the horn. Since the paths have different lengths and the microwave energy must be in phase at the interface with the curable assemblies at the outlet of the window, the window pieces are configured to delay the phases of the microwaves in one or more of the paths as needed. In other words, the window pieces are curved and dimensioned to form lenses for the microwave paths. The rear surface of the lens, according to a preferred embodiment herein, is configured by a series of adjacent flat surfaces to approximate a cylinder. One configuration has a middle flat surface with a pair of surfaces above and below angling forward at three degrees from surface to surface. In a single fin embodiment of this configuration, the single fin extends rearwardly from the center of the middle surface. For a three fin embodiment, fins are added extending from the breaks of the outer pairs of angling surfaces. To cool the window a serpentine channel is formed therethrough and cooling fluid, such as air at plant pressure, is pumped therethrough.

Different lens and fin configurations provide for different resultant heating patterns. This fact can be used to advantage according to this invention. The applicators mounted along the opposing side walls of the press chamber include applicators having significantly different heating patterns to thereby effect the microwave curing process and the resultant cured and compressed product in this continuous forming process. The applicators can be selected to accommodate for the fact that those downstream are acting on curable assemblies which have been partially heated and cured by those upstream. Upstream applicators can thereby be chosen to heat the top and bottom surfaces more than the center to make the surface areas near the press belts more compressible. The downstream applicators can then have a more even heating pattern. The upstream applicators can be single fin horns and the downstream ones can be triple fin horns, for example. The different heating patterns can compensate for different moisture, density, temperature and glue content variables within the incoming mat. The downstream applicators can also accommodate for uneven heating by upstream applicators.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

The usual desired mode of propagation in a waveguide is the $TE_{01}$ mode where the electric field is everywhere normal to the broad face of the guide, for example, a WR975 guide, or a nine and three-quarter inch by four and three-quarter inch waveguide, at nine hundred and fifteen megahertz. This field pattern is optimal for even heating but was not possible for larger products in the past as explained above. Thus, an objective of this invention is to regain as much as possible that purely transverse, straight electrical field propagating through the product. The microwave curing system of the present invention, as will be described below, provides an even heating pattern (see FIG. 11) from top to bottom of a larger depth of product, on the order of at least 11.4 inches. In terms of the electric field patterns of the microwaves, this is the equivalent of the electric vector being vertical and straight from the top press belt through the product to the bottom press belt, as will be explained in conjunction with FIG. 11.

Figure 1:
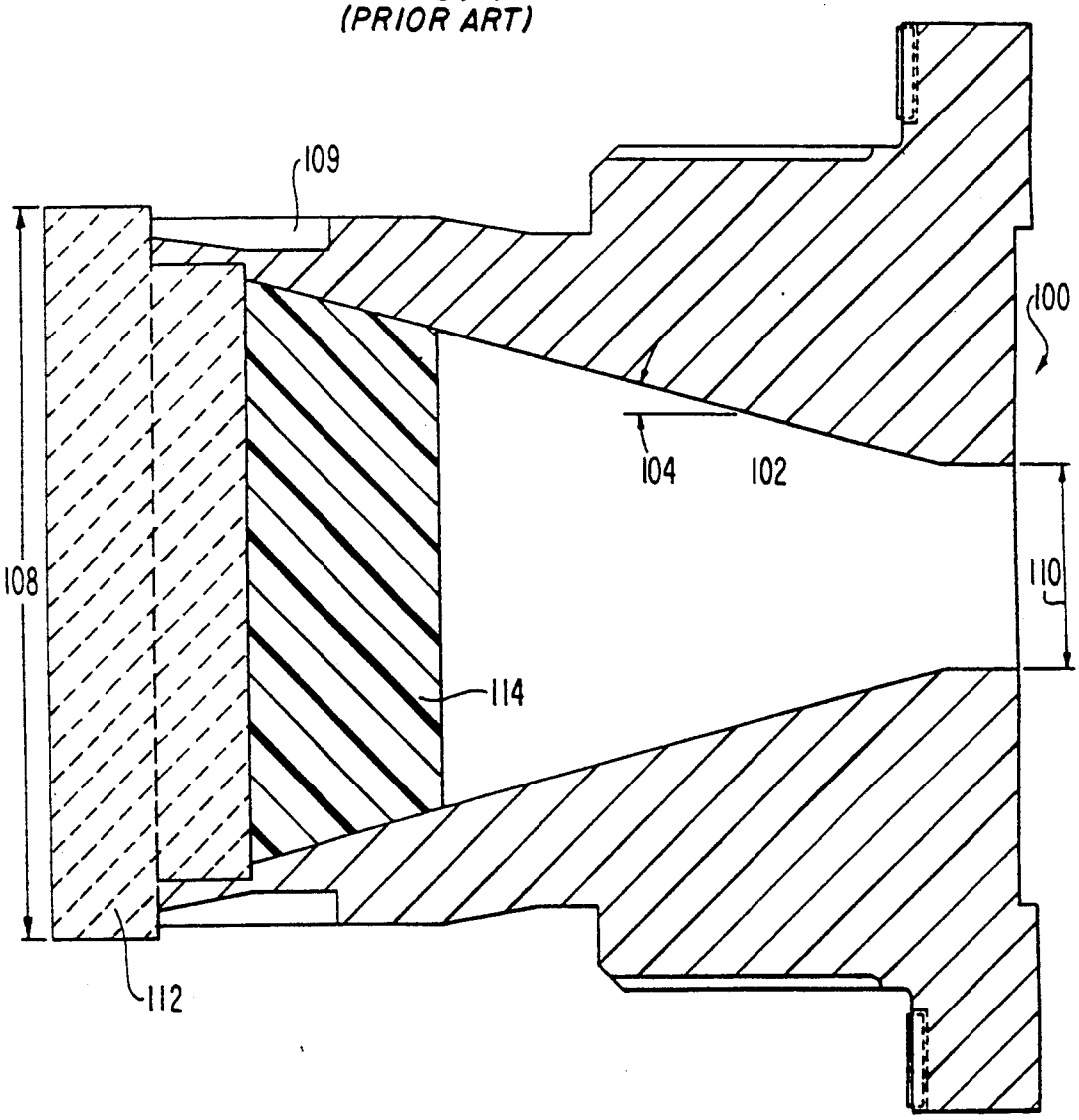
FIG. 1 (PRIOR ART)
FIG. 1 is a cross-sectional view of a "prior art" (as previously defined) microwave curing applicator.

It was determined that two geometries of the system 100 of FIG. 1 were preventing that objective from being attained. First, the rapidly expanding horn 102 created a cylindrical shape to the wave front which thereby distorts and becomes more complex in shape as it bounces off the parallel press belts. Second, the structure of the quarter wave traps 109 (as reported in the prior art) created a step discontinuity between the expanding horn 102 and the press belt which added further complexity to the shape of the electric fields. The complex shape of the electric fields changes the field strength dramatically along the field lines. Further, since heating is proportional to the square of the electric field, the effect of uneven fields on heating is even more pronounced. Significant modifications to the waveguide 102 of FIG. 1, and particularly additional structure added thereto, were thus determined to be needed.

Figure 3:
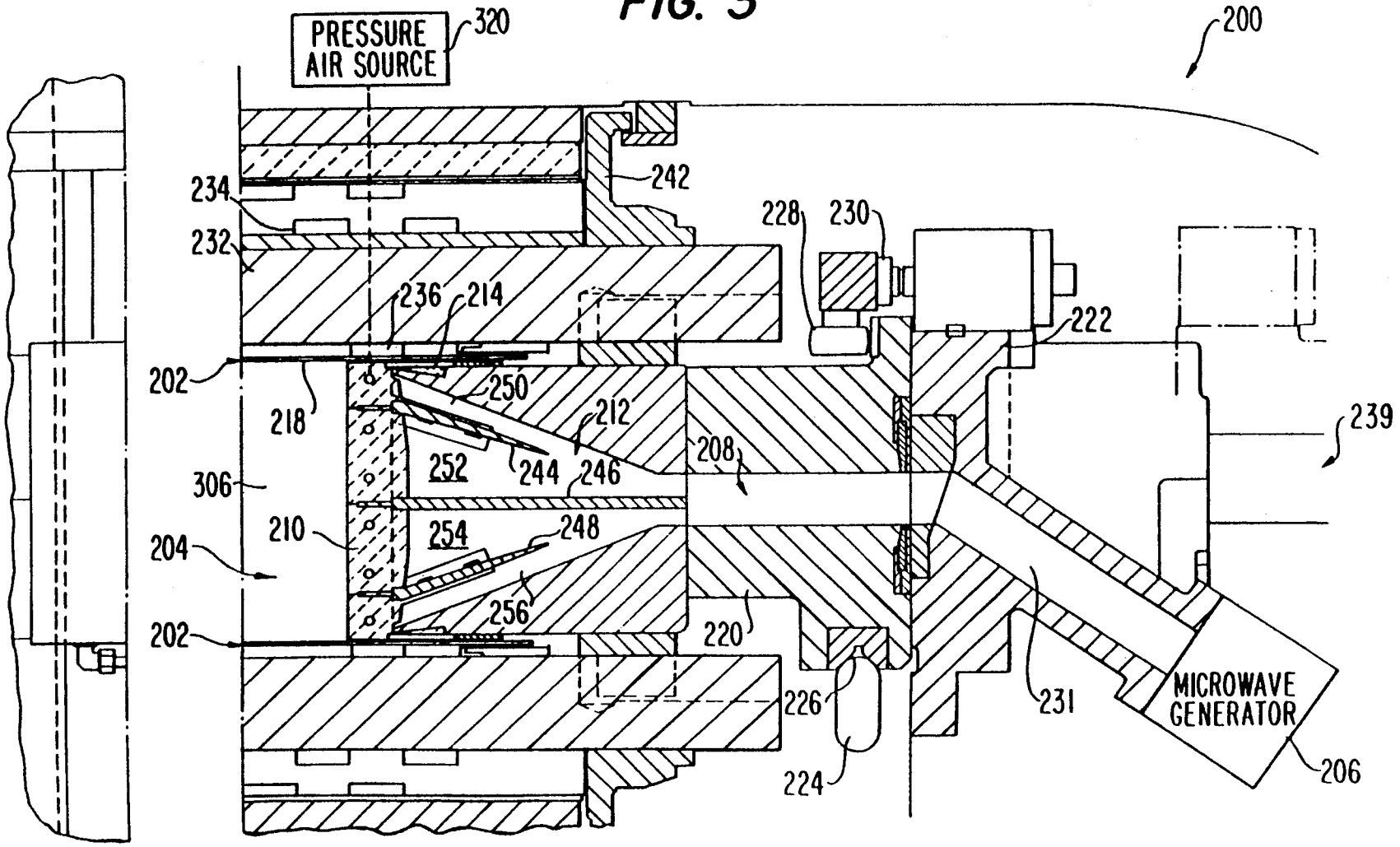
FIG. 3 is a cross-sectional view through a microwave curing and press assembly of the present invention.

A system of the present invention for compressing and microwave curing curable assemblies on a continuous basis is shown generally at 200 in FIG. 3. One-half of the system 200 is shown in FIG. 3, with the other half being a mirror image thereof and on the opposite side of the center line. (This may be made more apparent when considered in conjunction with FIG. 11.) The system 200 basically comprises an endless belt assembly shown generally at 202 and defining upper and lower surfaces of a press chamber shown generally at 204, a microwave generator shown schematically at 206, a microwave waveguide shown generally at 208 into which microwaves from the generator are applied and opening up into a side wall of the press chamber, a multi-piece dam 210 positioned at the end of the waveguide and interfacing with the product in the press chamber, a fin assembly shown generally at 212 mounted inside of the waveguide horn and extending into the dam and whose purpose and construction will be described later, and a quarter wave trap as shown generally at 214. Details of preferred arrangements for the belt assembly 202 are shown in copending U.S. application Ser. No. 07/456,657, filed Dec. 29, 1989, (and in Canadian application No. 2,006,947-3) and, in U.S. Pat. Nos. 4,508,772 and 4,517,148. A detailed discussion of preferred methods of forming adhesive coated, curable assemblies and depositing them on a continuous lay-up conveyor belt for conveyance to compressing and curing systems, such as system 200, is found in the '000 application, which is related to U.S. Pat. Nos. 4,872,544, 4,563,237, and 4,706,799, and in U.S. Pat. Nos. 3,493,021 and 4,546,886. Additionally, products containing oriented elongate strands such as might be used herein are disclosed in U.S. Pat. No. 4,061,819, which was reissued as U.S. Pat. No. Re. 30,636.

The belts of the belt assembly 202 in normal operation travel at speeds of about three to ten feet per minute. They apply a pressure of about three hundred to about nine hundred psi on the composite material in the press chamber 204. The waveguide 208 is illustrated in its extreme inward position in FIG. 3 and is normally drawn closer to the edge of the belts, which position is partially shown by the dotted lines. The width of the press can thereby be adjusted between twelve and seventeen inches, for example, to accommodate different products. One preferred setting is 14.75 inches but this depends on the desired end product.

The press belt assembly 202 comprises a press belt, shown in FIG. 3 at 218 as a thin layer extending underneath and on top of the applicator assembly. A side dam 220 is removable from the press, backing plates 222 fixed permanently to the press hold the side dam to the press and a donut-shaped wheel 224 sits in a V-shaped trough 226 on the side dam. A cam follower 228 on top and in the other orientation holds or pulls (to the left) the side dam 220 by a small hydraulic cylinder 230 to which the cam follower 228 is mounted. The cylinder 230 pulls the side dam 220 up against the backing plate 222 and makes a seal such that the microwaves from the generator 206 are caused to flow, without leaking, up the channel 231 at an angle, make the turn and flow through towards the window dam 210.

A series of roller chains 232 immediately above and below the belt 218 comprise the platen, friction reducing means between the belt and the press itself. The return lines 234 for the roller chains 232, which are the bearing surfaces, are shown in the drawing by the small staggered rectangles. In FIG. 3 two are represented, and immediately above and below the ceramic window 210 small rectangles 236 which perfectly match the size of those holes are shown. The holes are staggered in that platen to provide for mechanical structure for applying and supporting the platens through a metal plate that is also returning the chains. All of the stress of the pressure of the platens follows a zig-zag path through that chain return block. A large "O" frame 242 then completely surrounds the platen belt window assembly.

The hydraulic cylinders and their piston rods 239 are all on about eighteen inch centers, are about ten or twelve inches in diameter castings in series of two cylinders per block. They are thus only inches apart, and there is no room between them for the microwave generator 206 or connecting microwave tube 231. The microwave infeed 231 is thus positioned below the cylinders 239, and the tube 231 angles up to the applicator 208, as can be seen in FIG. 3. Also, the applicator 208 has a rapidly expanding horn shape, as opposed to a constant large cross section along its length, so that it is spaced from the hydraulic cylinders 239.

Electric fields, as a law of physics, attach themselves perpendicularly to metallic surfaces. The fin assembly 212 comprises three metallic dividers 244, 246, 248 added in the planes normal to the electric vector and dividing the expanding horn 208 into a series of smaller expanding horns 250, 252, 254, 256 as shown in FIG. 3. With the power flowing in the $TE_{10}$ mode, the fins 244, 246, 248 must extend horizontally relative to the incoming waves. If they have any other orientation, they would cause at least a partial short circuit in the waveguide 208 and dramatically perturb the flow of microwaves therethrough. The smaller horns or waveguides 250, 252, 254, 256 thereby formed suppress the formation of modes other than $TE_{01}$, because the size of each horn is below the cutoff for the $TE_{02}$ to $TE_{ON}$ modes. The horn partitions, dividers or fins 244, 246, 248 extend close to and beyond the quarter wave step 214 which thereby reduces the effect that the step has on the greater part of the field. It is important, however, when dividing the horn 208 into the smaller horns 250, 252, 254, 256 to ensure a near perfect phase matching in the plane 260 of the product/window interface at the termination of the horn, and this result is provided by the unique construction of the present window dam 210.

Figure 6:
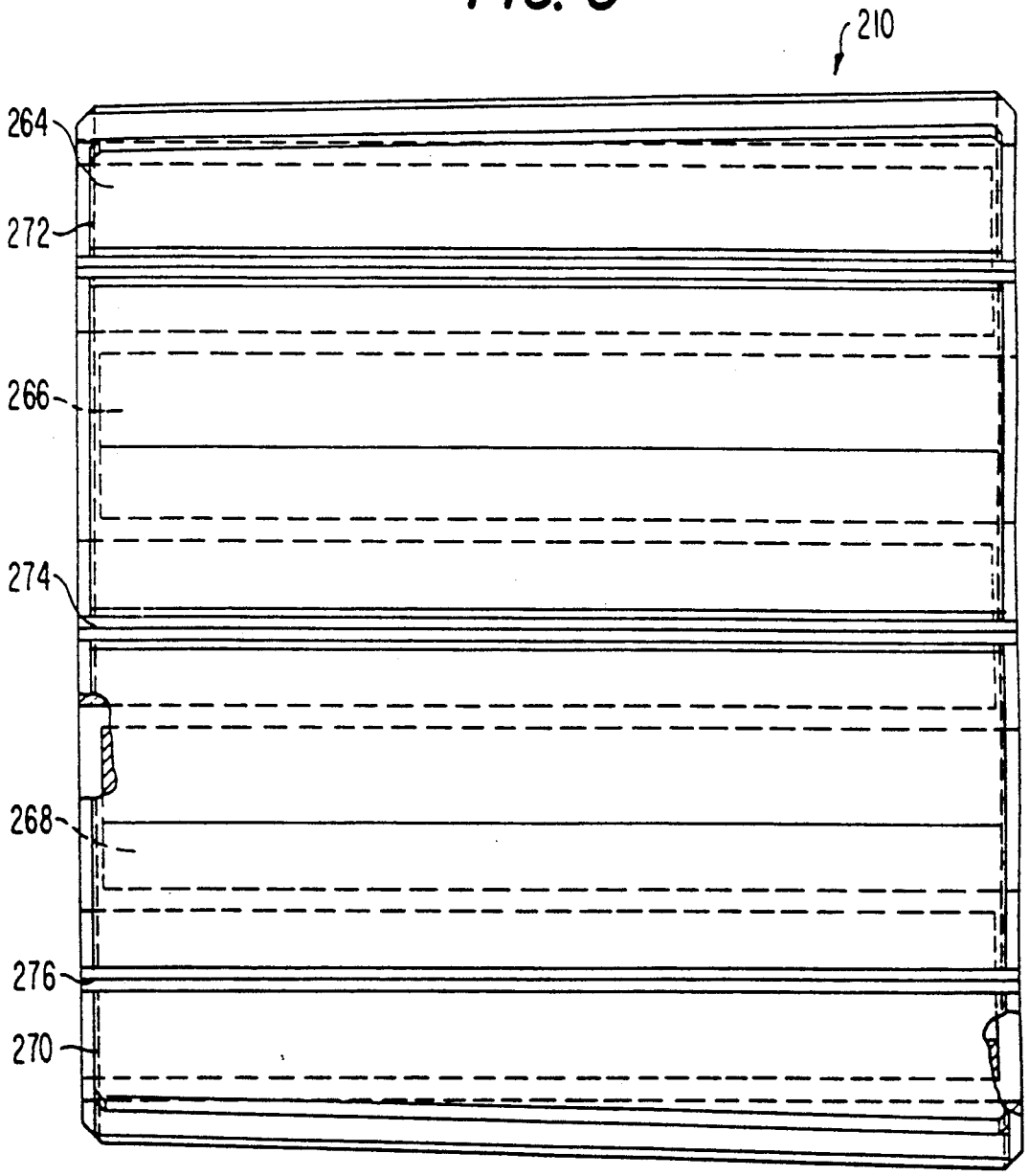
FIG. 6 is a rear elevational view of the ceramic window, illustrated in isolation, of the applicator horn of FIG. 3 with portions thereof broken away for illustrative purposes.
Figure 7:
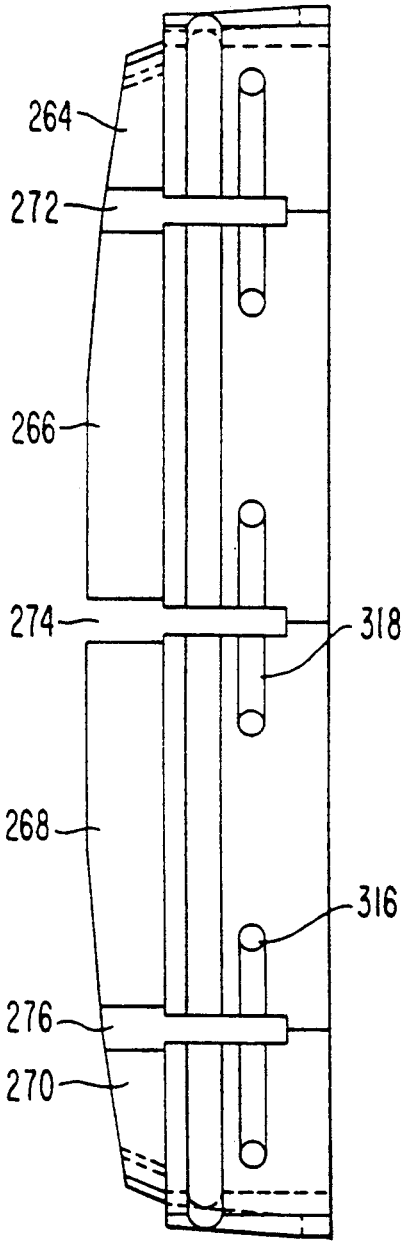
FIG. 7 is a side elevational view of the window of FIG. 6 and in the same orientation of that in FIGS. 3 and 4.
Figure 8:
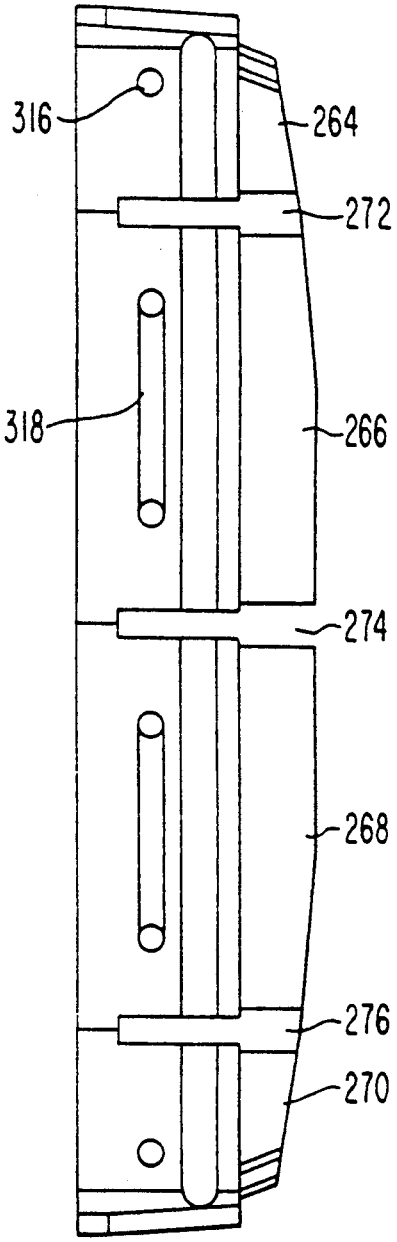
FIG. 8 is a side elevational view of the other side of the window of FIG. 7.

The fins 244, 246, 248 extend into the window 210 beyond the one-quarter wave step 214 as far as possible to reduce the distortion of the step on the electric fields. This extension also supports and positions the ceramic window 210, which is herein advantageously comprised of four bar segments 264, 266, 268, 270, as seen in FIGS. 6–8, for example. The center of a solid alumina ceramic window of the same size would reach 450° Fahrenheit or more. In contrast, the edges of the window are cooled by cooling air and water or by contact with the water-cooled aluminum or steel frame, which supports the two outside pieces of the four piece ceramic. The expansion of the hot center can thus create a stress on the cold rim resulting in window cracking, which in turn can ultimately cause the window to fail. The fins 244, 246, 248 fit into three slots 272, 274, 276 formed in the rear surface of the window 210 to support the window. These slots 272, 274, 276 define stress relief cracks in the window 210, as can be seen in FIGS. 7 and 8. They also divide the large window into the four smaller windows 264, 266, 268, 270, and these smaller windows accordingly show a significantly reduced tendency to crack under thermal stress than does a single large window. In other words, the window 210, now made in the four pieces 264, 266, 268, 278, is supported by the fins 244, 246, 248 projecting into the ceramic assembly. The fins 244, 246, 248 not only divide the power evenly within the horn 208 but also have sufficient strength to support the three hundred to five hundred psi pressure on the window/product interface from the curable assemblies being pressed thereagainst. It has been determined that each one of the bars or elongated ceramic window pieces 264, 266, 268, 270, each of which has a length of about 9.75 or ten inches, can actually support a three hundred psi pressure in its long beam direction.

The fins 244, 246, 248 reduce the formation of secondary modes. The flow of the microwave energy is more stable in the small chambers, horns or waveguides 250, 252, 254, 256 formed by the fins before it reaches the ceramic window 210 than it would be in a similar wide open horn. Thus, when the microwave fields in a wide open horn are perturbed, an unstable oscillating and undulating of those fields results. In contrast, the small horn chambers 250, 252, 254, 256 formed by the fins of the present invention tend to stabilize the fields. They tend to return to a true $TE_{01}$ mode, and higher order modes are thereby suppressed.

The fins 244, 246, 248 are made out of aluminum as is the horn 208 and its mount. The center fin 246 goes back approximately six or eight inches, and the upper and lower fins 244, 248 extend back three or four inches at an inward angle. Alternatively, the fins can extend back a much shorter distance and still have a sufficient mechanical spring if they have suitable engineering properties, stiffness and strength. The fins are preferably machined from approximately one inch thick plate. The end of the edges of that section are machined half round, and half-round machining into the block 208 to accept that half round piece is made. This allows the fins 244, 246, 248 with their shaped tips and tapered tails to be accurately positioned to support the tremendous loads which will bear on them. Bolts hold the fin in position, and the shoulder of the one-inch half cylinder 280 bears the load. The fins 244, 246, 248 are bolted into place, and the surfaces thereof are then machined for final fitting of the ceramics. Each fin is thus uniquely assigned in the applicator 208 and not interchangeable with any other fin. In other words, the fins and their two half cylinders are each machined from a single piece and slid out and removed from the waveguide 208. To assemble them, they are slid back down that half-cylinder channel built into the main block and two bolts are then inserted on either side thereof and tightened to hold them in place. Alternatively and in lieu of this individual fit, the fins and ceramics can be attached to a framework (not shown) and slipped into the horn. The tips 284, 286, 288 of the fins 244, 246, 248, respectively (the right hand tips as depicted in FIG. 4), are not permanently welded but rather are floating or cantilevered out.

Figure 4:
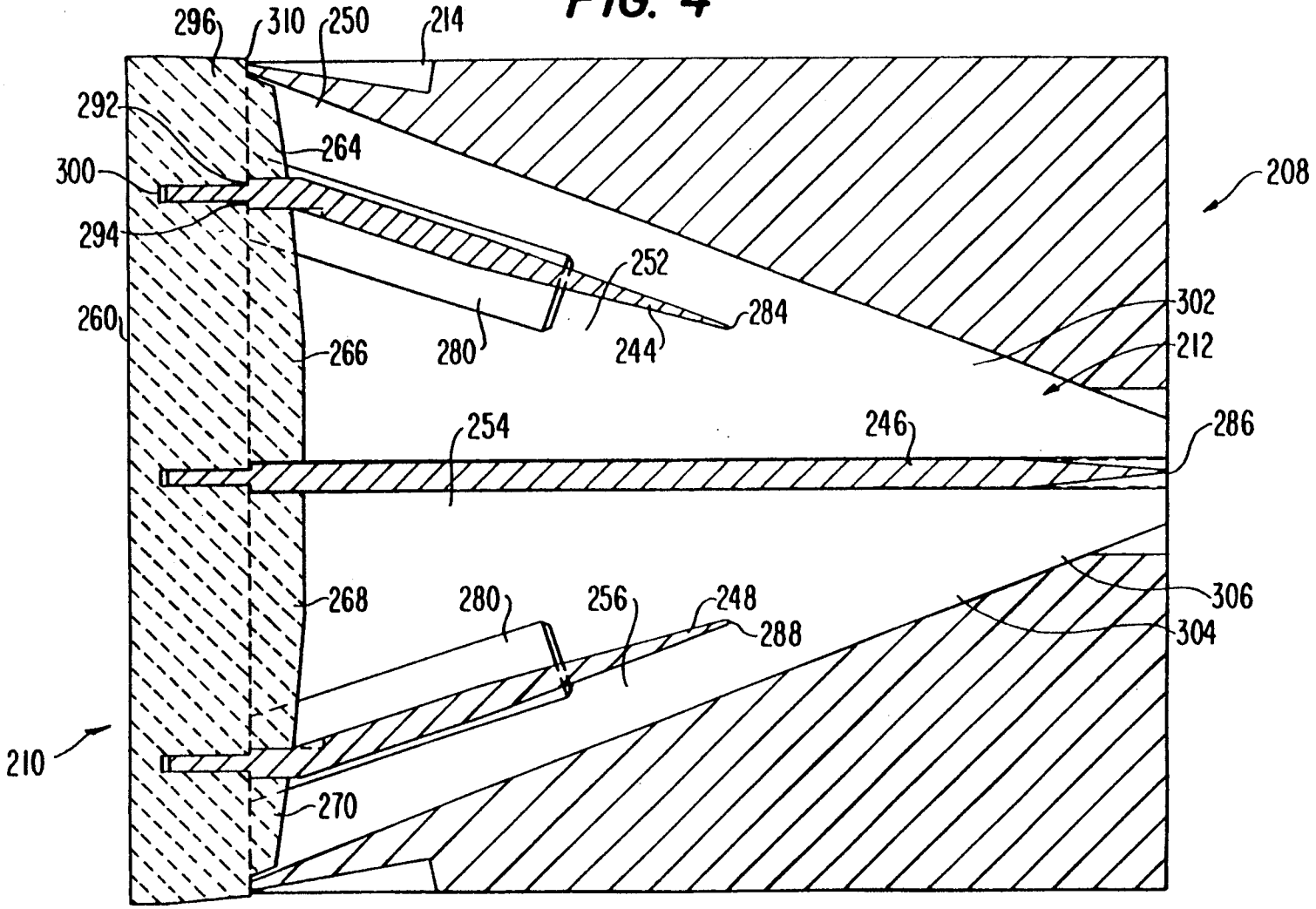
FIG. 4 is an enlarged view of the (three fin) applicator horn of the assembly of FIG. 3 illustrated in isolation.

Referring to FIG. 4, at the left-hand side of the right-hand part of the fins, there is a step 292 at the top and a shoulder 294 at the bottom of that step that supports the ceramic. In fact, there is a step at the outer edges of the product at the top and at the bottom. The plane 296 of those five steps is exactly parallel to the window face 260 and defines the shape of the window 210 and the position in which it is held. The ledge also advantageously becomes a quarter wave transformer for the forwardmost tips 300 of the fin. The tips 300 of the fins are discontinuities, and the ledges 292 that support the ceramic are also discontinuities. These two discontinuities are positioned a quarter wave length apart and thereby form a quarter wave transformer. Accordingly, the reflection caused by the first discontinuity is cancelled by the reflection caused by the second. As shown in FIG. 4, the tip 300 is twice as big as each of the two steps 292, 294; that is, it is as big as the sum of the two edges on either side of a single fin. This forms a step transformer which phase matches the reflections coming off the tips such that the energy flows into the product.

Figure 10:
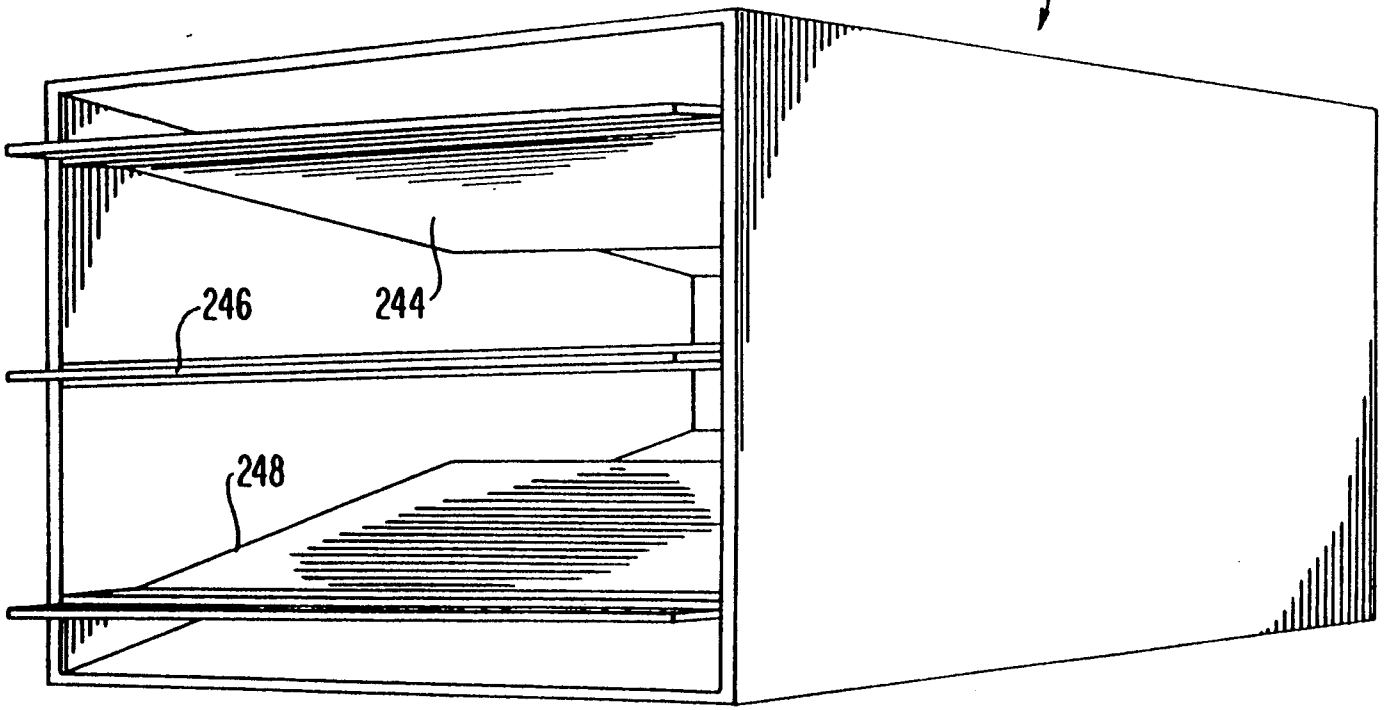
FIG. 10 is a perspective view of the exit end of the applicator horn of FIG. 1, with the ceramic window omitted for purposes of illustrating the fin assembly in the horn.
Figure 11:
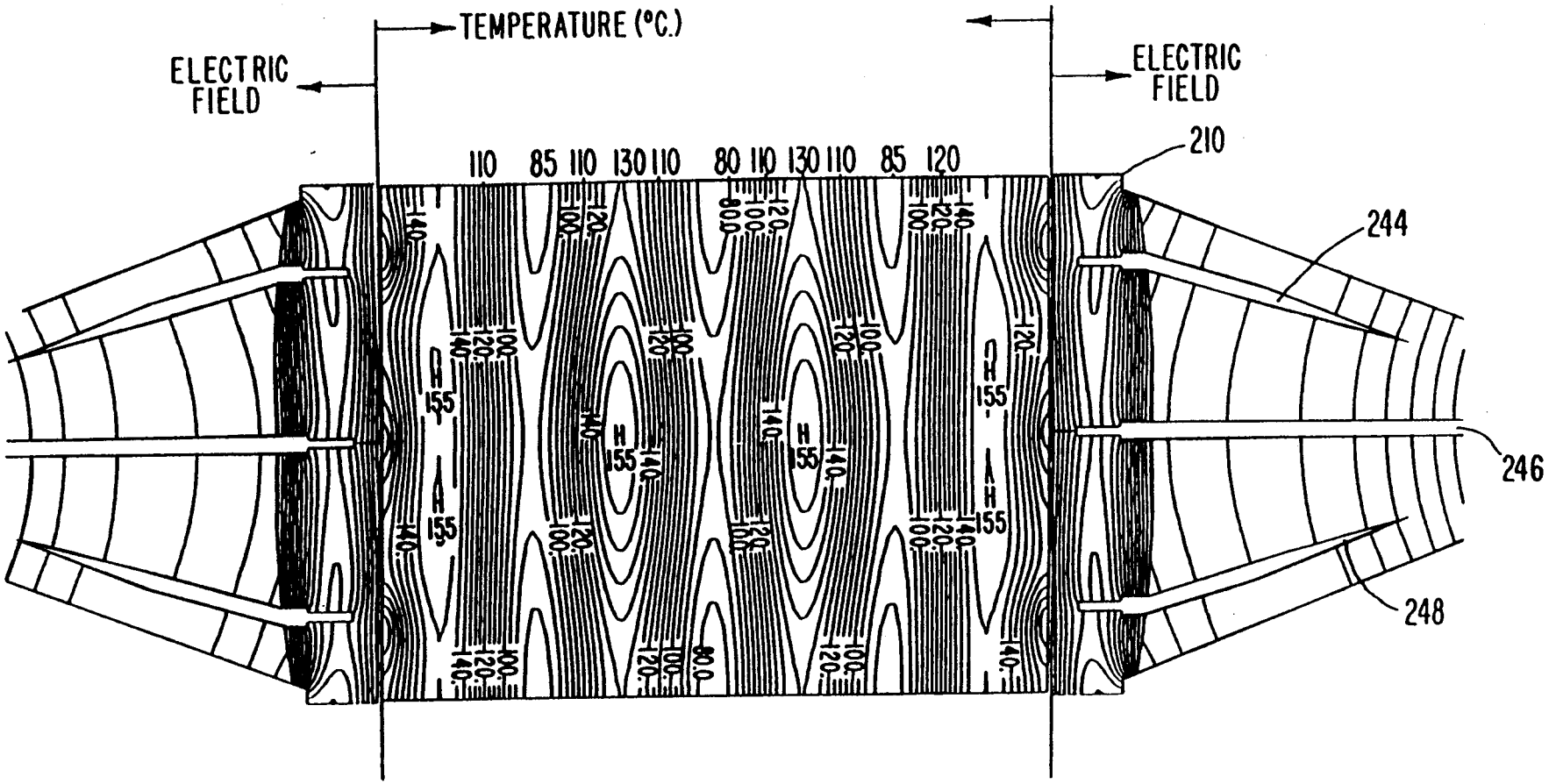
FIG. 11 is a computer-generated temperature profile in the product and the electric field in the applicator using the system of FIG. 3.

The fin assembly 212 is permanently bolted into the waveguide 208, as previously explained, and extends horizontally across the rectangular guide, as can be seen in FIG. 10. The center plate fin 246 is ten millimeters thick, runs the length of the applicator and divides the waveguide into two very distinct waveguides shown generally at 302, 304. Each of the outer fins 244, 246 divides the created waveguides 302, 304 into two more waveguides, thereby creating the four waveguides 250, 252, 254, 256 opening to the ceramic window 210. Each ceramic piece 264, 266, 268, 270 then fits into the end of its respective waveguide 250, 252, 254, 256. The ceramics have been sized and shaped to delay the energy flow from each of the four waveguides so that they are all in phase at the front of the window. It is seen in FIG. 11 that the electric fields at the face 260 of the window 210, very close to the product, form almost perfect vertical lines going top to bottom, and the degree to which they are perfect is the degree to which the assembly heats evenly and hot spots in the product are less likely to be created.

The ceramic window 210 is made in graduated thicknesses to form a plane wave at the product/ceramic interface, and the window pieces or lenses 264, 266, 268, 270 have their curvatures determined using optical type techniques and waveguide calculations. Referring to FIGS. 3 and 11, the microwaves propagating through the point at the start of the central plane fin 246 first travel through clean dry air 306 in the horn 208 to the ceramic 210 and then through ceramic to the product. As can be understood from the geometry, those microwaves that are expanding out along the surface of the horn going upwards and downwards have a longer flight path to reach the front of the ceramic 210. The thickness of the ceramic 210 thus changes gradually to delay the wave arrival times at the front of the ceramic so that all wave components arrive at the same time. That delay time is accordingly a function of how fast the microwaves travel—first in air 306 and then in ceramic 210. Since they travel slower in ceramic, the ceramic window 210 is made thicker to slow them down as needed in the center, as shown in the drawings. In other words, the thicker ceramic center phase delays those waves that would be ahead because they are part of a spherical front and would otherwise reach the front of the plane of the window first.

Figure 9:
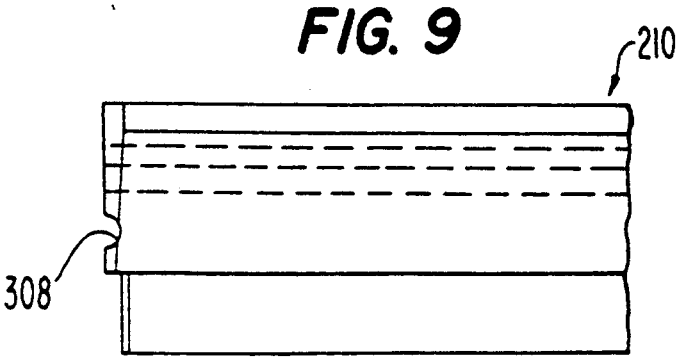
FIG. 9 is a partial top view of the window.

As shown in the top view of the ceramic window 210 in FIG. 9, there is a 4.25 millimeter radius half-circular cut 308. A corresponding half-circular cut is provided in the aluminum block. After the ceramics 264, 266, 268, 270 are installed, a pin (not shown) is slid down the half circle on either side, and the ceramic window 210 is thereby blocked from falling out the mouth of the applicator 208; the pin thus captures the ceramic pieces in and to the horn.

The window pieces 264, 266, 268, 270 are made of ceramic instead of Teflon, which has little strength. The ceramics are preferably a relatively high purity alumina $Al_2O_3$ and have a dielectric constant between nine and ten. The dielectric constant determines the thicknesses of the window pieces 264, 266, 268, 270 and along with guide size is directly related to the speed of the microwaves in the ceramic. Since the ceramic window 210 has a high dielectric constant, the lens is relatively flat.

It is seen in FIG. 11 that the cylindrical radiused electric field travels through the applicator 208, strikes the ceramic window 210 and is effectively straightened out. Although it is theoretically possible to make a perfect vertical line out of those fields, in reality there is some degree of electric field variation. There is also a reflection from this surface that is a complex function of many things including the incident angles and relative dielectric constants, so there is some distortion of that field caused by the reflection. Similarly, there is a reflection of the interface between the product and the ceramic 210, and it is the interaction of those interfaces that determines how perfectly this electric field enters the product.

Figure 5:
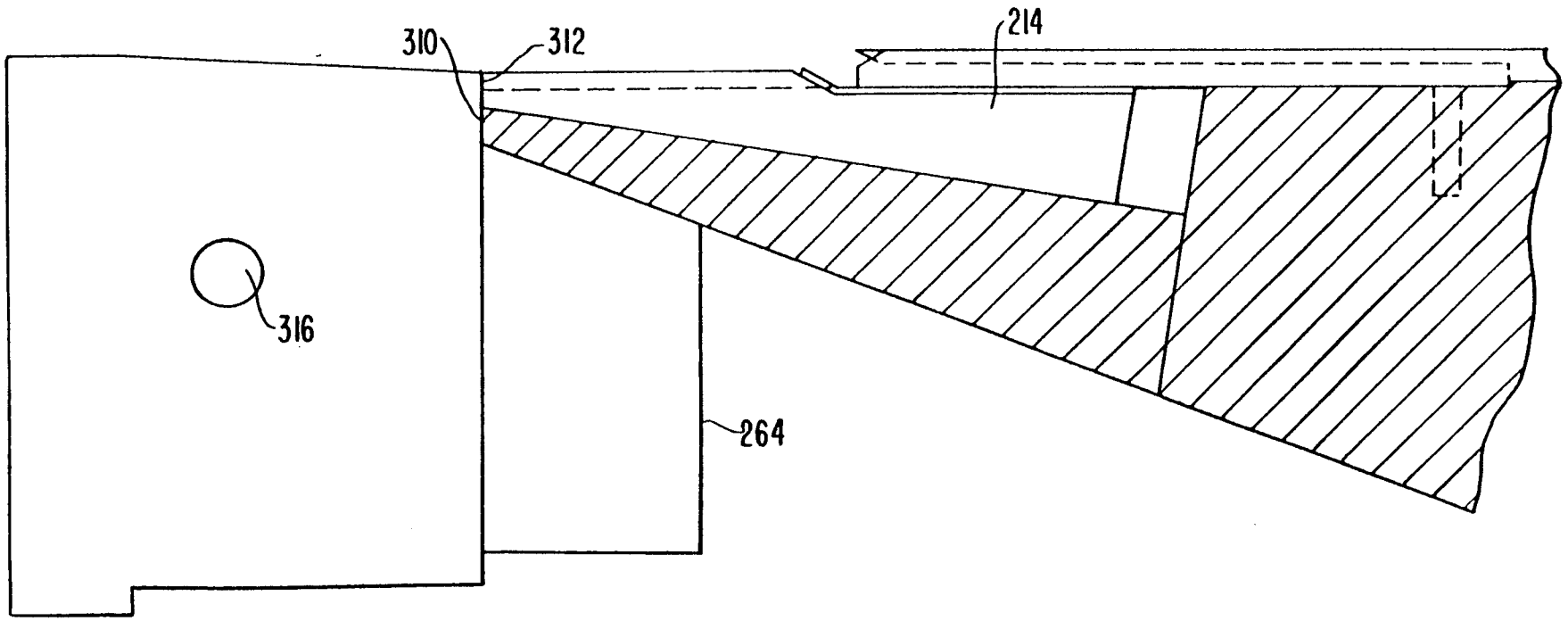
FIG. 5 is an enlarged view of the quarter-wave trap area of the assembly of FIGS. 3 and 4.

As shown in FIG. 5, at the top and the bottom of the product in the applicator 208 are steps 310 where the angle portion of the guide steps down and then extends horizontally to the product, or steps up and goes virtually to the top of the product. Those steps are virtually impossible to eliminate because of the need for quarter wave traps 214, and they distort the electric fields. The geometric size of the quarter wave traps 214 has been herein minimized to a degree sufficient to provide even heating.

The quarter wave trap 214 has the size of the step from the horn to the belt. This area is herein as small as can be mechanically made, machined and maintained. The step herein is made quite small by making the leading edge 312 of the quarter wave trap where it meets the window 210 at the edge of the aluminum as small as possible, on the order of two or three millimeters. There is also about two or three millimeters of aluminum support—the mounting frame for the two outside pieces of ceramic 264, 270.

Referring to FIGS. 3, 7 and 8, six-millimeter bore holes 316 are formed in the ceramic window 210 for cooling it. An air return channel 318 extends between the second and third holes, and the air return channels are staggered as can be understood when considering FIGS. 7 and 8 together. The air thus enters the top hole in FIG. 8, goes down the length and returns to the second block, back to the second block, and returns within the second block and so forth—zig-zagging or serpentining its way through the windows. Small tubes (not shown) are preferably fitted and cemented with silicone in these serpentine bore holes to ensure that the air does not leak out of them. The air is blown into the bore holes 316 from a source of compressed air as shown in FIG. 3 at 320, such as air from the mill as would be more apparent from '000 application, and having a pressure of about one hundred psi, for example. Alternatively, if more air flow is beneficial the air can be fed to each ceramic bore from a manifold and collected at the other end reducing the resistance to air flow.

Thus, to develop an even heating pattern from top to bottom in the 11.4 dimension of the composite microwave-curable product, structure was added, pursant to this invention, to the applicator horn 208 and the horn design was altered to create as even an electric field as possible at the product/horn interface and thereafter across the product. This structure includes the window 210—the layers of microwave transparent material of a known dielectric property added to the inside of the horn to phase delay the cylindrical expanding wave. The one quarter wave traps 214 were modified to minimize the discontinuity, to reduce the field distortions in this area. The structure further includes the metallic dividers or fin assembly 212 added in the plane normal to the electric vector to divide the expanding horn 208 into a series of smaller horns 250, 252, 254, 256 and also to secure the pieces 264, 266, 268, 270 of the dam window 210 in place.

Figure 2:
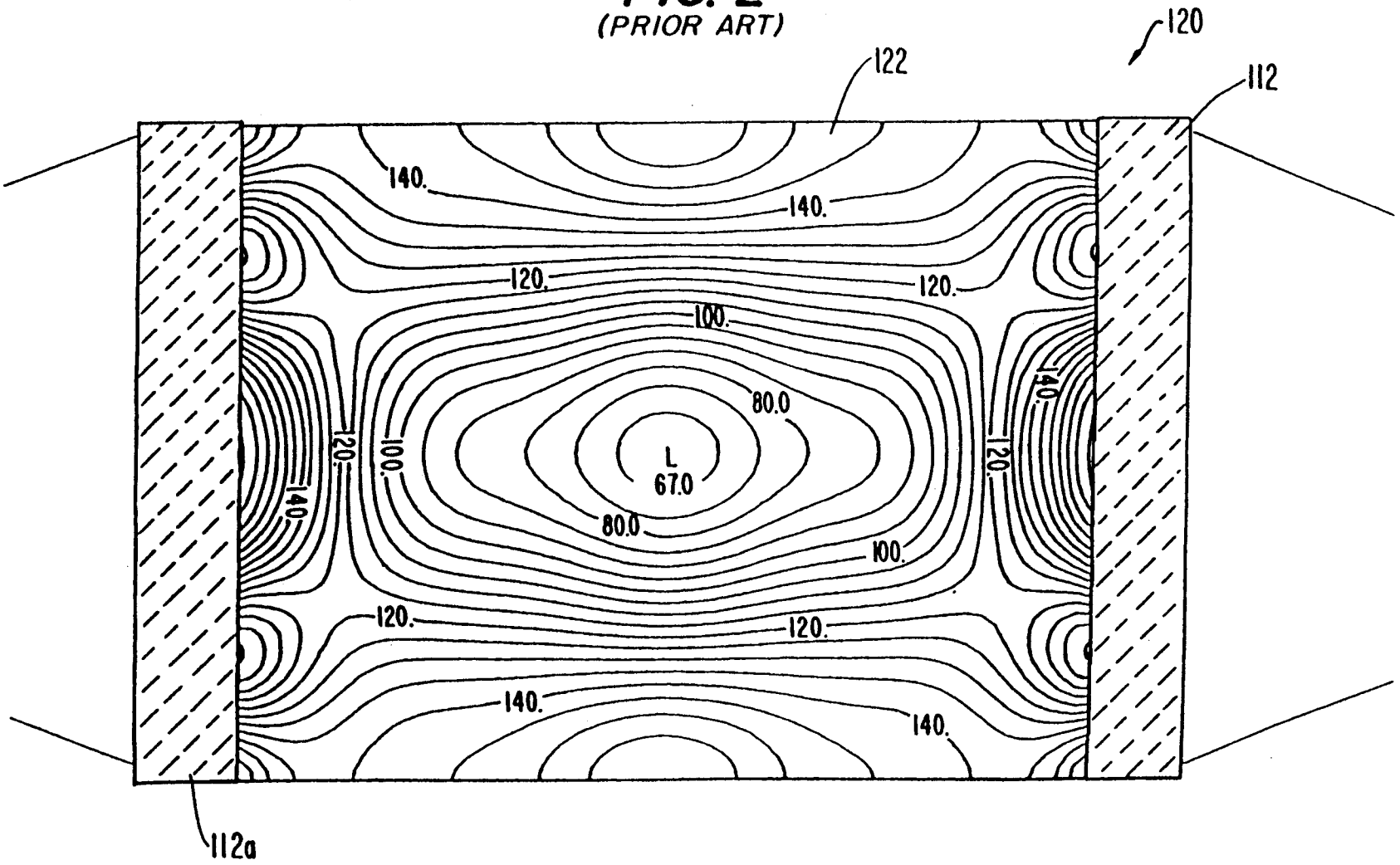
FIG. 2 (PRIOR ART)
FIG. 2 is a computer-generated isothermic drawing of the compressed curable assemblies immediately after exposure to the microwaves from an applicator similar to that of FIG. 1.

FIG. 11 shows the isotherms and electric fields resulting from the additions and modifications of the present system and the consequent heating pattern for one estimated set of dielectric parameters of an epsilon single prime of three and an epsilon double prime of 0.3. This drawing shows the isotherms in degrees Centigrade, wherein the "H" designates the high temperature areas and the "L" designates the low temperature areas. As can be seen, the temperature ranges from a high of about 155° C. to a low of about 80°. This low, however, is sandwiched between two relatively hot areas which are very close together and thus a short time later steam transport from the higher temperature into the lower temperature occurs. There is thus only a distance of a little more than an inch between the highs and lows compared with the nearly seven inches of the prior art product as shown in FIG. 2. Accordingly, not only do the highs have lower temperatures and the lows have higher, but the highs and lows are spaced closer—close enough for effective steam transport between them. Thus, with the product of FIG. 11 and after about ten or fifteen minutes, a thermograph (not shown) from a cross section cut of the product would show a difference in temperature of only plus or minus 10°. In other words, the hot and cold spots would have essentially disappeared, and a consistent normalization of the thick product thereby advantageously results.

The microwave generator 206 operates preferably at nine hundred and fifteen MHz, which is an Industrial Scientific Medical (ISM) band. These applicators 208 operate in the same electric field mode, the $TE_{10}$ mode, as described in the '498 patent. The total power in the system 200 from one window 210 is about twenty-five kilowatts in normal usage, though it can be higher. It is anticipated that there will be sixteen windows in a preferred layup process, as shown in the '000 application, for a total of four hundred kilowatts, which makes about two million cubic feet of product a year. This relatioship is effectively linear so that if twice the power were provided, twice the product could be made.

Figure 12:
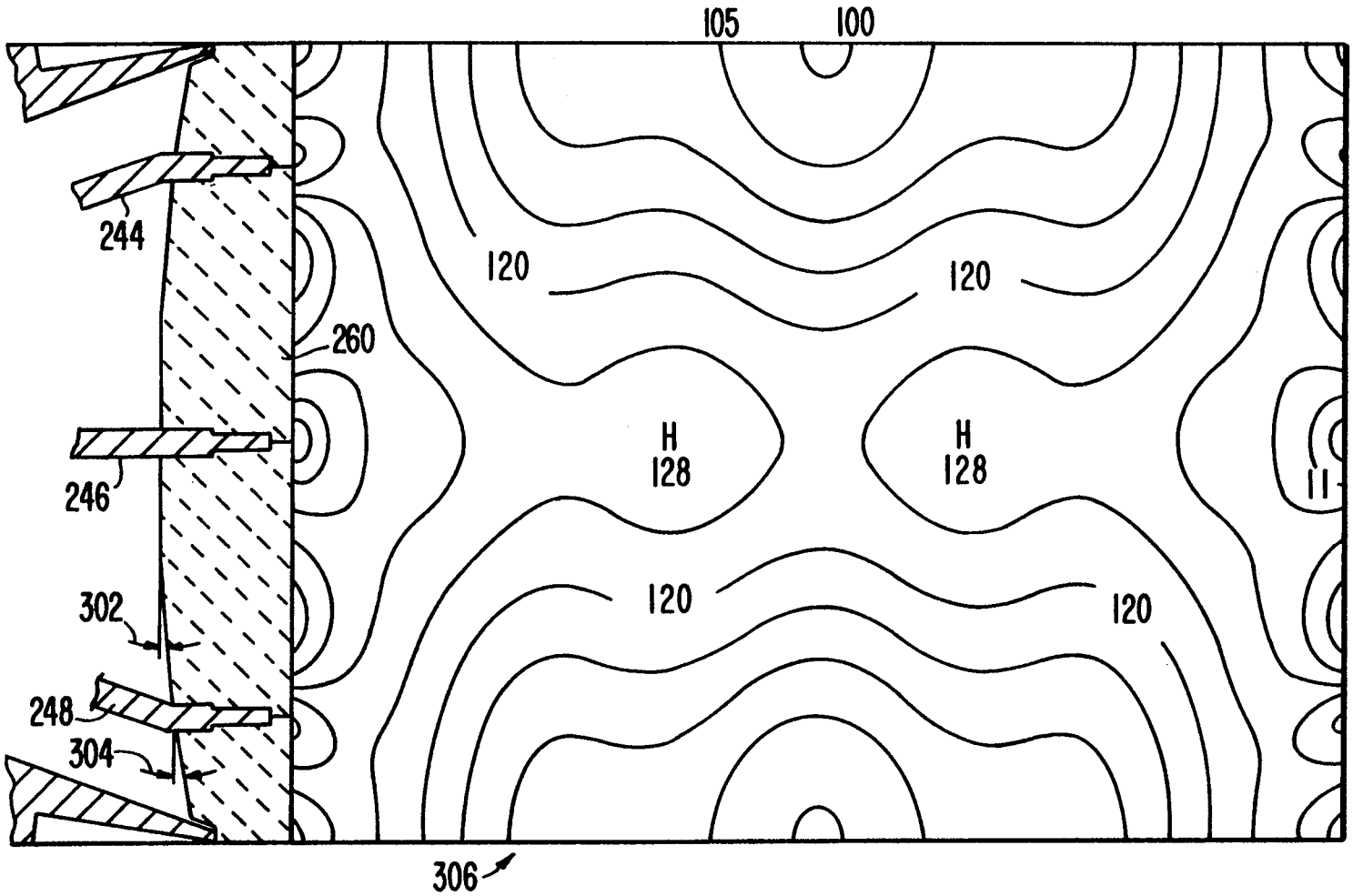
FIG. 12 is a computer model temperature profile similar to that of FIG. 11 except taken in a different place in the dielectric spectrum.

The rearward surface 290 of the dam or lens is configured to approximate a cylinder; that is, it is a cylindrical surface. It is shaped by a series of connected straight lines or planar surfaces. In a preferred embodiment and as shown in FIGS. 4 and 12, the surface is comprised of five line segments or surfaces, namely, the central planar (vertical) surface 292, the two surfaces 294, 296 at the outer edges of the lens and the two surfaces 298, 300 between the edge and the central surfaces. The outer fins 244, 248 are positioned between the connecting surfaces and the outer surfaces, respectively. The central fin 246 passes through the center of the center surface 292. The connecting surfaces and the central surface define respective break angles at the junctures. These are shown by angle 302 (four and a half degrees) in FIG. 12. Similarly, the connection and the edge surface defines a second break angle 304 (nine degrees) with the central surface or the planar. The second break angle 304 is approximately twice that of the first. In other words, the angle between the connecting and central surfaces equals the first angle 302. These angles and line segments are selected so that the rear surface 290 approximates a cylinder.

The embodiments of FIGS. 4 and 12 have first and second angles 302, 304 of 4½ and 9°, respectively. For these angles and this three fin arrangement the computer model temperature profiles are shown in FIGS. 11 and in FIG. 12 at 306. The profile 306 of FIG. 12 differs from that of FIG. 11 as it is taken at a different place in the dielectric spectrum. It is taken at an epsilon prime of three and an epsilon double prime of three. The profile 306 of FIG. 12 is perhaps a better approximation of the actual temperature profile in the product which itself is a function of the glue and moisture contents and is variable. In other words, the profile 306 of FIG. 12 represents a better selection of parameters to estimate the actual heating pattern. The profiles of FIGS. 11 and 12 are very similar though. If they were allowed to diffuse, remarkably similar sets of hot and cold spots will result. The 155° hot spot of FIG. 11 will sit on top of the 128° hot spots of FIG. 12, and the cold spots of 80° of FIG. 11 will sit on top of the 100° cold spots of FIG. 12. Although the relatively cool spots at the base of the windows are moved slightly and modified slightly, they function the same. From the product's viewpoint, these are similar heating patterns.

Figure 13:
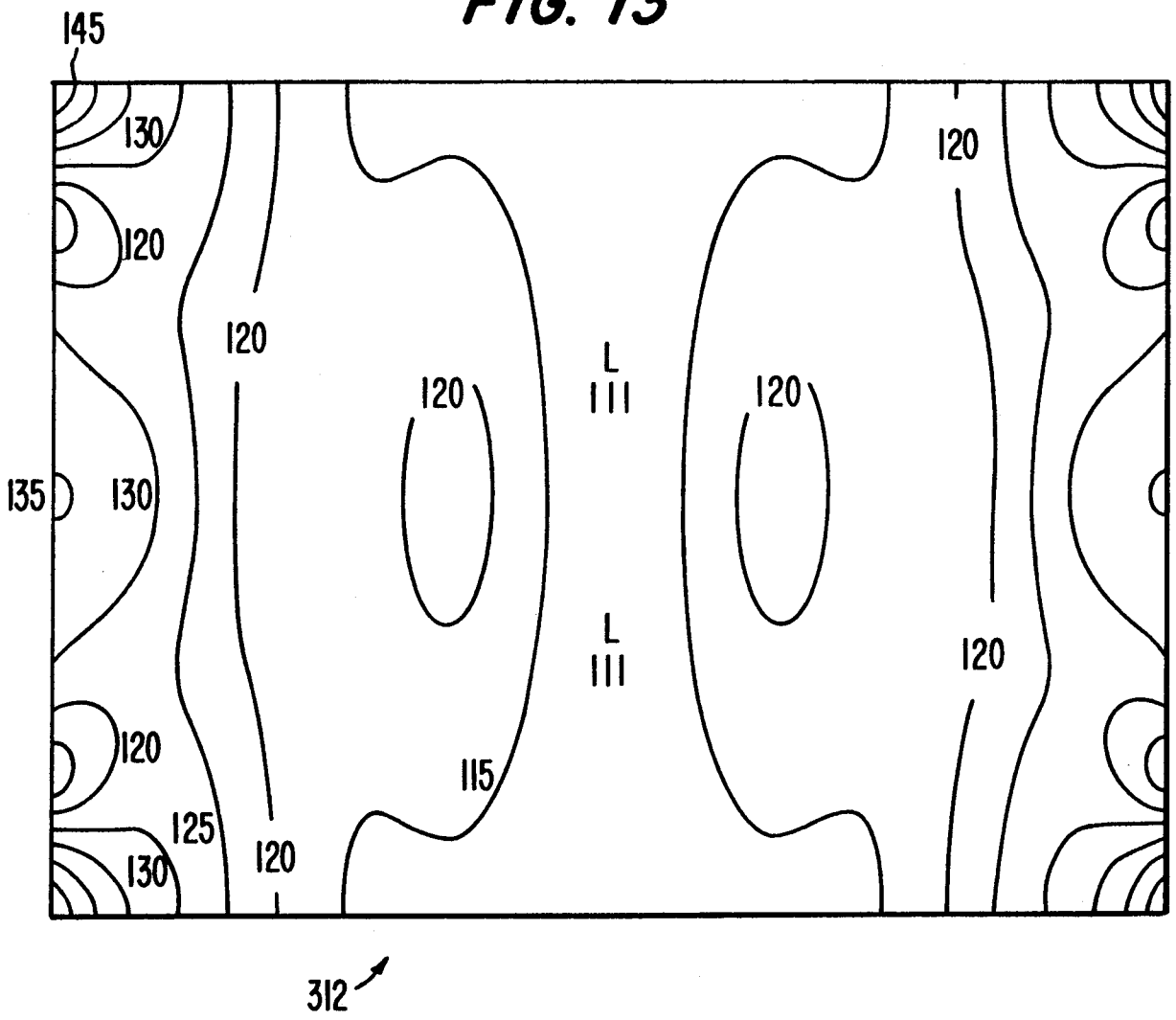
FIG. 13 is a profile similar to that of FIG. 12 except for a three-six degree lens configuration instead of a four and a half-nine degree lens configuration.

Recent tests have shown that a better configuration of the rear surface of the lens is to have angle 302 be 3° and angle 304 be 6°. The heating pattern resulting from this configuration is shown in FIG. 13 generally at 312, which is apparently the most even and thus best heating pattern. The lowest or coolest point is in the center the 111° C. band going vertically from top to bottom with little deviation. There is a large area around 120° on either side of it and the 125° band is very close to the surface. With the exception of the very tiny corners which are at 145° no other areas exceed 135°. In other words, the two hot lobes of 128° in the profile 306 of FIG. 12 have been eliminated. The fact that the small fringes have higher temperatures is inconsequential because the corners of the product are cooled in operation by stream escaping from the product. In other words, they influence only a very small volume of the product and tend to diffuse to a more even profile. Angle 302 can also be between two and a half and three and a half degrees and angle 304 between five and a half and six and a half degrees.

Figure 14:
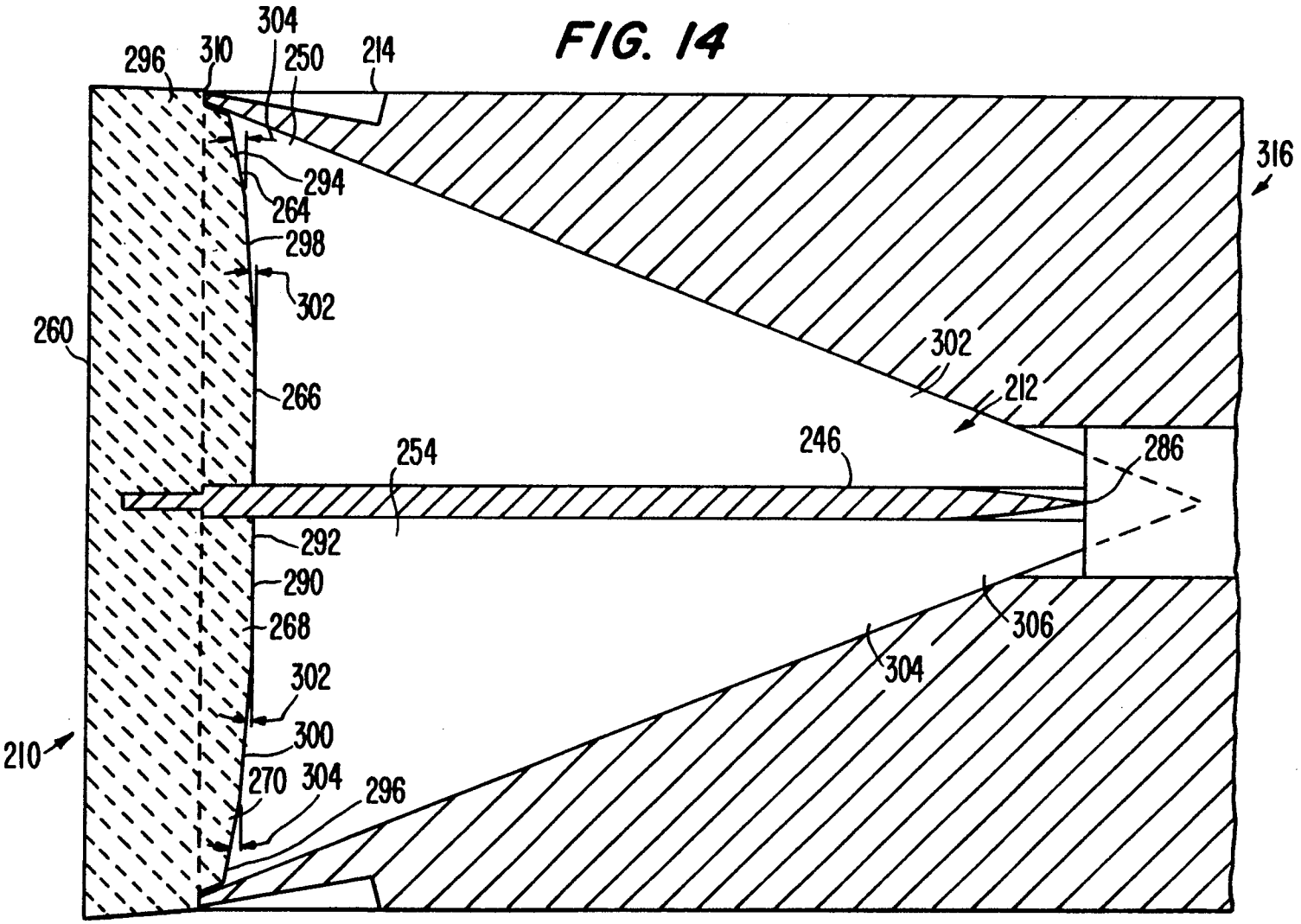
FIG. 14 is a view similar to that of FIG. 4 of an alternative (single fin) horn of the present invention.
Figure 15:
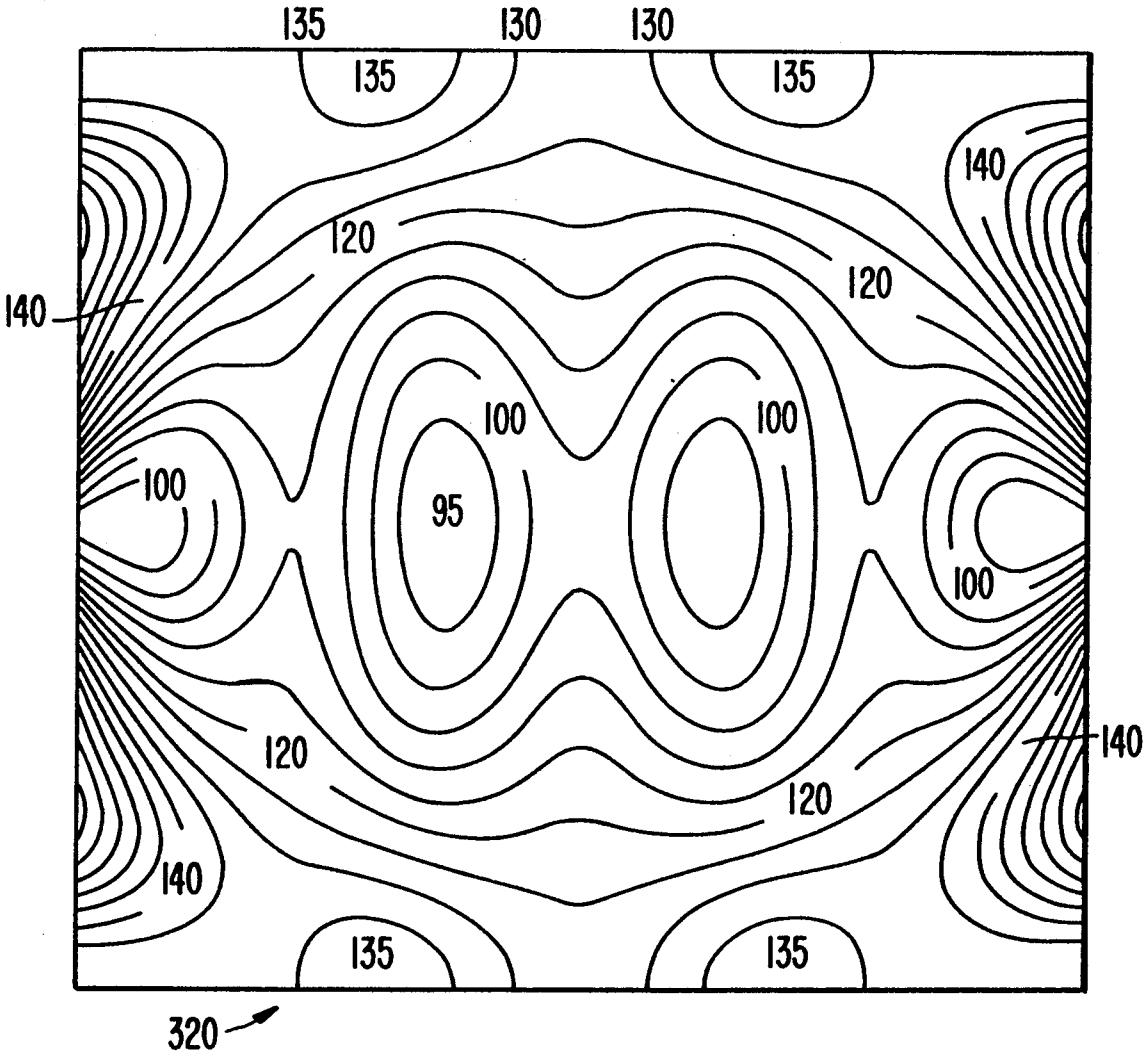
FIG. 15 is a computer model temperature profile similar to that of FIG. 13 using applicator horns of FIG. 14 from both sides of the mat.

An alternative to the horn embodiment of FIG. 4 is the horn embodiment of FIG. 14 shown generally at 316 wherein the outer fins are not used. This can be done by removing the outer fins and filling in the holes or slots in the back surface of the lens with ceramic to smoothly fill across the gap. Although tiny cracks may result, they are too small to be seen by the relatively long wave length of the microwaves. Instead of forming the lens with four pieces and filling in the two resulting empty slots or gaps, the preferred way is to simply make the lens or dam as two pieces with the central fin 246 positioned between them. This is shown in FIG. 14. The window shown in FIG. 14 is a larger window on the order of fourteen or fifteen inches high as opposed to 11.4 inches as previously described. It has angles 302 and 304 of 3° and 6°, respectively, and the resulting temperature profile is shown in FIG. 15 generally at 320. It is seen therein that hot spots of 135° are formed on the top and bottom surfaces and cold spots of 95° in the central area. To some effective degree the cold and hot spots of the profile of FIG. 15 correspond with those of FIG. 13, that is, the 120° hot spots of FIG. 13 would sit on top of the 95° spots of FIG. 15.

Figure 16:
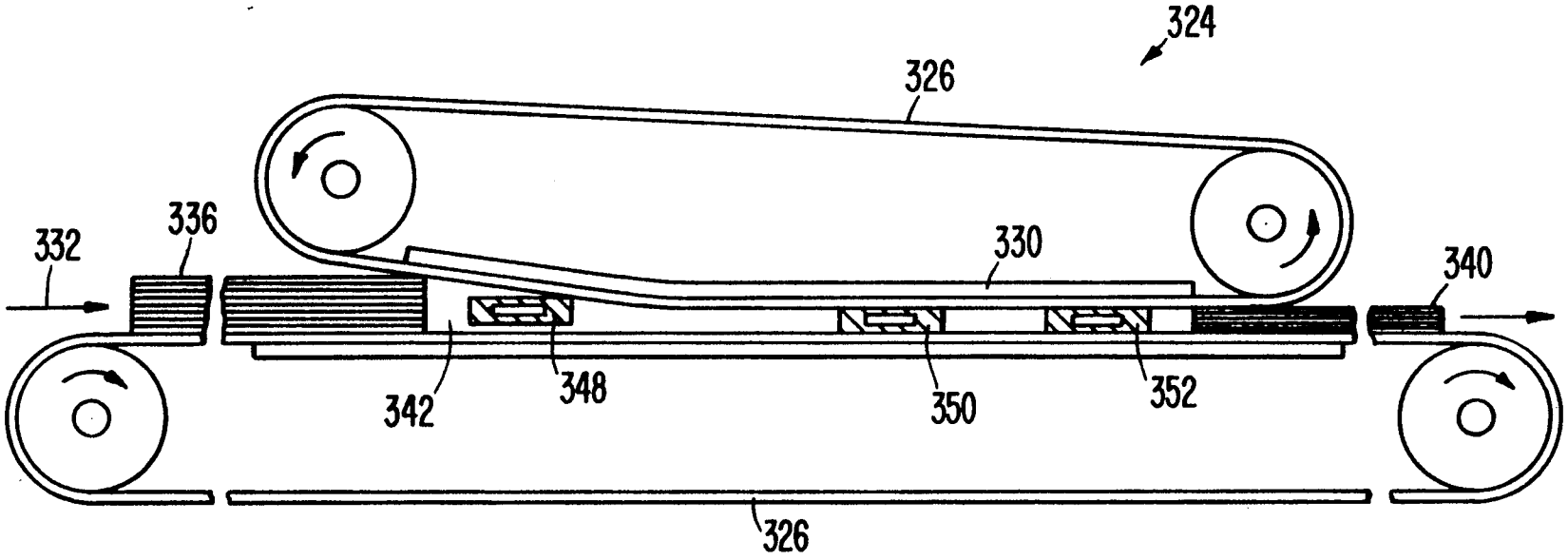
FIG. 16 is a side elevational cross-sectional view of a continuous press of the present invention using at least first and second different applicator horns, such as those of FIGS. 4 and 14.

A belt press with microwave applicators typically uses a number of pairs of applicators along the length of the press chamber. Thus, as the curable assemblies, such as adhesively bonded, interwoven layers of thin wood strands (See the '732 application; Canadian application 2,022,900-4; and International Application No. PCT/US91/05065, filed Jul. 23, 1991 and entitled "System for Oriented Strand Lay-Up"), are conveyed into the press chamber on the conveyor and between the two converging metal press belts, the curable assemblies are subjected sequentially to microwave energy from a number of different applicators as they are conveyed through the press chamber. An example of a press belt arrangement is shown in FIG. 16 generally at 324 and is described in further detail in the '498 patent. It is seen therein that the continuous press 324 comprises a pair of steel press belts 326 having belt positioning means including an upper belt and a lower belt, which loop back upon themselves so as to form continuous belts. Pressure transfer means 330 transfer compressive forces to the belts. The belts are driven in the direction of arrow 332 and in operation the curable assemblies move in this direction, enter the nip of the continuous press and are compressed to a maximum degree upon reaching the press section of the press. Examples of belt presses are those disclosed in U.S. Pat. Nos. 4,508,722 and 4,517,148, and preferred presses are disclosed in copending U.S. application Ser. No. 07/456,657, filed Dec. 29, 1989 (Canadian application 2,006,947-3 and International Application No. PCT/CA90/00459). While the curable assemblies 336 are under compression in this press section, the microwaves are directed from a plurality of microwave applicator horns into the curable assemblies as they are conveyed past them. After passing out the end of the press section the cured assemblies 340 are removed from the press. The sidewalls 342 prevent the curable assemblies which are under compression from escaping laterally from the press section. The dams of the applicator horns are secured in openings in the sidewalls 342. In the past, it has been known to use approximately between two and eight applicator horns on each side of the press. Half of these horns were positioned before or upstream of the parallel press region.

A preferred continuous press for the present invention takes advantage of the different heating patterns available from using different applicator horn configurations. Use of different heating patterns at different locations along the conveyance travel of the curable assemblies has a number of advantages. It can take advantage of the fact that later or downstream heating patterns are focused on curable assemblies which have been at least partially heated or cured. Further, the different patterns will tend to even out under further compression, curing and subsequent cooling providing with careful control a more evenly heated product. The problems of uneven density profiles of the mat or layup and resultant uneven heating in the microwave press are discussed in copending U.S. application Ser. No. 07/575,007, filed Aug. 30, 1990 (Canadian application 2,025,555-2, and International Application No. PCT/US91/05054, filed Jul. 22, 1991 and entitled "Wood Composite Forming and Curing System"). For example, the heating profile of FIG. 15 can be used for the first three or four applicators or windows followed by the rest of the press comprising four or five applicators using the heating pattern of FIG. 13. (A total of only three applicators or horns 348, 350, 352 are shown though in FIG. 14 for illustrative purposes.) Separate or a common microwave generator(s) (206) can be used for each of the applicator horns. See, e.g., U.S. Pat. No. 4,020,311. The frequency can be 915 Hz and the power from each applicator can be 25 KW. The first three or four windows then tend to heat the surface near the press belts more than the center to make the compressible assemblies slightly more compressible in this area. This tends to compensate for the cold spots in the layup by using differential microwave heating patterns. The applicator horns of FIG. 14 can be in the wedged or contracting portion of the sidewalls and thus can be slightly taller on the order of fourteen inches as opposed to 11.4 inches and have a width of approximately ten inches at the front of the window.

The heating pattern resulting from the single fin embodiment of FIG. 14 and shown in FIG. 15 confirms what was expected in that less even heating on the surface of the window results when fins are removed. This is shown by the high density of the isotherms on the surface of the window. This is a more severe and thus generally less desirable heating pattern than that of FIG. 13. A result which can be taken advantage of is that hot spots of 135° result on the top and bottom surfaces. In contrast, the warmer spots of FIG. 13 are in the center though they are only warmer by less than 10°.

As an example, the heating patterns of the first applicator can have average top and bottom surface temperatures at least 10° F. greater than those of the second heating pattern compared with their respective averages; the first heating pattern can have average top and bottom surface temperatures which are preferably 30° F. greater than those of the second heating pattern compared to their respective averages; the first pattern can have average temperatures in generally the middle thirds of the top and bottom surfaces thereof at least 10° F. greater than those of corresponding locations of the second heating pattern, each compared to their respective averages; and the second heating pattern can have an average temperature in the central region thereof which is 10° greater than that of the first heating pattern with respect to their average temperatures. The difference in unevenness between the two patterns can be greater than 10° F. Both patterns can have unevennesses of approximately 20° F. These patterns (or horns) are also spaced approximately eighteen or thirty-six inches apart along the press bed.

When using applicator horns having FIG. 13 and FIG. 15 profiles in a single continuous press, the temperature profiles as measured by infrared camera systems are better than that resulting from FIG. 13 alone. This is because of the averaging of the many window heating patterns and also the time between the heating being applied and the observation being taken; there is some diffusion of energy throughout the system which evens the heating. The use of a plurality of heating profiles also allows the system to accommodate different product characteristics. It will be able to tolerate a greater range of moistures, densities and temperature variabilities within the mat. The system can make a better, more evenly heated product over a broader range of glue content variables as well, since glue acts as a strong absorber of the microwaves.

The actual precise positioning of the break angles 302, 304 and the amounts of these angles can be empirically modified to optimize the evenness of heating. They can be set at an effective radius defined theoretically or empirically by using models to test out shapes and observing heating patterns. The use of three line segments or flat surfaces 292, 294, 298 defining two angles is for practical purposes a good solution, as the cost of grinding the ceramics (lenses or dams) is not insignificant. The tuning of a lens from a 4½°-9° angular relation to a 3°-6° relationship requires that only three millimeters of thickness be ground away from the center of the window. The accuracy of the configuration of the rear surface is within a couple of millimeters which is considerable greater accuracy than would appear to be required from a traditional optical analysis wherein an accuracy of one-twentieth lambda for grinding accuracy of lenses is an optical industry standard. A one twentieth of a wavelength of the microwaves of this invention would be approximately a half centimeter.

The present invention carefully controls near field patterns to provide an even distribution of heat. Near field refers to distances of inches or feet in front of the applicator where a very complex distribution pattern for energy density is found. In contrast, antenna systems are designed to broadcast, and not heat. Their near field heating patterns are thus of no interest to the designer and are usually unsuited since nothing is done to control them. Antennae system designers are only concerned with the far field. Thus, the present invention relates to a method of having a very small guide (on the order of fifty mm) apply energy evenly across the face of a very large piece of ceramic (on the order of three hundred mm) in a very short distance (on the order of four hundred and fifty mm). The present invention creates a single phase front and where it is not perfect it will have very high order modes, on the order of five or higher.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. For curing assemblies, a microwave assembly comprising:

an expanding microwave waveguide having a microwave inlet which is communicable with a microwave source, an outlet, a first pair of opposite walls flaring away from each other from said inlet to said outlet, and a second pair of opposite walls connecting ends of said first pair of walls;

a microwave transparent dam closing said outlet; and at least one fin extending between said second pair of opposite walls and from said dam toward said inlet and dividing said expanding waveguide within said first and second pairs of walls into a plurality of discrete expanding waveguide passages, said waveguide passages being sized to maintain microwave energy travelling in through said microwave inlet and through said waveguide in substantially the same mode in each of said waveguide passages;

wherein said dam has a rear surface facing toward said inlet, said rear surface forming a lens structure shaped to retard the advance of microwave energy adjacent the center of said dam more than the microwave energy adjacent the edges of said dam at said first pair of walls so that the microwave energy leaving said dam is in substantially the same mode and same phase relationship across substantially the full area of said outlet.

2. The microwave assembly of claim 1 wherein said lens structure comprises a plurality of planar surfaces defining angles at their junctures.

3. The microwave assembly of claim 2 wherein said straight surfaces include an outer edge surface, a planar center surface and a middle connecting surface directly connecting said edge and center surfaces, such that a first angle is defined between said center and connecting surfaces and a second angle is defined between said center and edge surfaces.

4. The microwave assembly of claim 3 wherein the second angle is twice as large as the first angle.

5. The microwave assembly of claim 3 wherein the second angle is nine degrees and the first angle is four and a half degrees.

6. the microwave assembly of claim 3 wherein the second angle is six degrees and the first angle is three degrees.

7. The microwave assembly of claim 3 wherein the second angle is between five and a half and six and a half degrees and the first angle is between two and a half and three and a half degrees.

8. The microwave assembly of claim 3 wherein said fin means comprises a fin extending rearwardly from said center surface.

9. The microwave assembly of claim 8 wherein said at least one fin includes outer fins extending rearwardly at the juncture of said edge and connecting surfaces.

10. The microwave assembly of claim 9 wherein said outer fins are held in slots in said rear surface.

11. A microwave curing and pressing system for curable assemblies, said system comprising:

a press chamber including a side wall assembly;

press belt means for continuously advancing curable assemblies through said press chamber;

first microwave applicator means for applying, through said side wall assembly, microwaves in a first heating pattern to the curable assemblies in said press chamber and as they are advanced therethrough at least in part by said press belt means; and second microwave applicator means for applying, through said side wall assembly and downstream of said first microwave applicator means, microwaves in a second heating pattern to the curable assemblies in said press chamber and as they are advanced therethrough, the second heating pattern being different than the first heating pattern to accommodate the fact that being downstream the curable assemblies have already been partially heated by the first heating pattern.

12. The system of claim 11 wherein the first heating pattern has average top and bottom surface temperatures at least ten degrees Fahrenheit greater than those of the second heating pattern compared to their respective averages.

13. The system of claim 11 wherein the first heating pattern has average top and bottom surface temperature which are thirty degrees Fahrenheit greater than those of the second heating pattern compared to their respective averages.

14. The system of claim 11 wherein the first heating pattern has average temperatures in generally the middle thirds of the top and bottom surfaces thereof at least ten degrees Fahrenheit greater than those of corresponding locations of the second heating pattern, each compared to their respective averages.

15. The system of claim 14 wherein the first and second heating patterns are spaced approximately eighteen inches apart along the press bed.

16. The system of claim 11 wherein said press belt means defines a nip region and said second microwave applicator means is downstream of the nip region.

17. The system of claim 16 wherein said first microwave applicator means is downstream of the nip region.

18. The system of claim 16 wherein said first microwave applicator means is upstream of the nip region.

19. The system of claim 11 wherein the microwaves from said first and second microwave applicator means have the same frequency and power.

20. The system of claim 19 wherein the applicators' frequency is 915 MHz and the power is 25 KW per applicator.

21. The system of claim 11 wherein said side wall assembly includes first and second side walls on opposite sides of said press belt means.

22. The system of claim 21 wherein both said first and second microwave applicator means apply their microwaves through said first side wall.

23. The system of claim 21 wherein said first microwave applicator means applies microwaves through said first side wall and said second microwave applicator means applies microwaves through said second side wall.

24. The system of claim 21 wherein said first microwave applicator means includes a first applicator horn in said first side wall and a second applicator horn in said second second wall, opposed to and aligned with the first applicator horn.

25. The system of claim 11 wherein the second heating pattern has an average temperature in the central region thereof which is ten degrees greater than that of the first heating pattern with respect to their average temperatures.

26. The system of claim 11 wherein said first and second applicator means include first and second, respective, microwavetransparent dams in said side wall assembly.

27. The system of claim 26 wherein said first microwave applicator means includes a single fin only assembly extending rearwardly from said first dam and dividing all of the microwaves passing through said first dam into a pair of wave paths, and said second microwave applicator means include three spaced fins extending rearwardly from said second dam and dividing all of the microwaves passing through said second dam into four wave paths into the curable assemblies.

28. The system of claim 26 wherein both said first and second dams have the back surfaces thereof shaped as cylindrical lenses.

29. The system of claim 11 wherein the first heating pattern is more uneven than the second heating pattern.

30. The system of claim 29 wherein the difference in unevenness between the two patterns is greater than ten degrees Fahrenheit.

31. The system of claim 29 wherein the first heating pattern has an unevenness of approximately 20° F. and the second heating pattern has an unevenness of approximately 20° F.

* * * * *